US011420660B2

(12) United States Patent
Piccirilli et al.

(10) Patent No.: US 11,420,660 B2
(45) Date of Patent: Aug. 23, 2022

(54) LUMINOUS DEVICE FOR RAIL WAYS SIGNALS AND THE LIKE, AND MANAGEMENT METHOD THEREOF

(71) Applicant: HITACHI RAIL STS S.P.A., Genoa (IT)

(72) Inventors: Eduardo Piccirilli, Isernia (IT); Emilio Lanzotti, Montesarchio (IT); Fausto Del Villano, Torre Annunziata (IT)

(73) Assignee: HITACHI RAIL STS S.P.A., Genoa (IT)

( * ) Notice: Subject to any disclaimer, the term of this patent is extended or adjusted under 35 U.S.C. 154(b) by 236 days.

(21) Appl. No.: 16/648,857

(22) PCT Filed: Jul. 18, 2018

(86) PCT No.: PCT/IB2018/055318
§ 371 (c)(1),
(2) Date: Mar. 19, 2020

(87) PCT Pub. No.: WO2019/058188
PCT Pub. Date: Mar. 28, 2019

(65) Prior Publication Data

US 2020/0276993 A1 Sep. 3, 2020

(30) Foreign Application Priority Data

Sep. 19, 2017 (EP) ..... 17191872

(51) Int. Cl.
*B61L 5/18* (2006.01)
*H05B 45/44* (2020.01)
*G08G 1/095* (2006.01)

(52) U.S. Cl.
CPC ..... *B61L 5/1881* (2013.01); *H05B 45/44* (2020.01); *B61L 2207/02* (2013.01); *G08G 1/095* (2013.01)

(58) Field of Classification Search
CPC ..... H05B 45/44; H05B 45/48; H05B 45/46; H05B 45/357; H05B 45/3578;
(Continued)

(56) References Cited

U.S. PATENT DOCUMENTS 7,936,135 B2 * 5/2011 Hum ..... H05B 45/37 315/297
9,441,795 B2 * 9/2016 Segers ..... H05B 45/3578
(Continued)

FOREIGN PATENT DOCUMENTS

EP 1233654 A1 8/2002
EP 2463174 A1 6/2012
WO 2005038476 A1 4/2005

OTHER PUBLICATIONS

International Search Report; priority document.
(Continued)

*Primary Examiner* — Monica C King
(74) *Attorney, Agent, or Firm* — Greer, Burns & Crain, Ltd.

(57) ABSTRACT

The invention relates to a luminous device (5) and a method for managing said device (5), comprising LED lighting means (51), a dissipative electric load (52) adapted to increase an electric power dissipated by the device (5) when the LED lighting means (51) are emitting light, and current interrupting means (53) configured for dynamically interrupting the flow of current through said dissipative load (52) when the LED lighting means (51) are emitting light, so as to reduce the electric power dissipated by said device (5).

12 Claims, 6 Drawing Sheets

(58) Field of Classification Search
CPC .... H05B 45/3725; H05B 47/20; H05B 45/10; H05B 45/36; H05B 45/37; H05B 45/375; H05B 45/38; H05B 45/382; H05B 45/50; H05B 45/54; H05B 47/10; H05B 47/165; H05B 47/17; H05B 47/24; H05B 47/26; Y02B 20/30; B61L 2207/02; B61L 5/1881; F21K 9/27; G08G 1/095; F21Y 2115/10; F21Y 2103/10; F21V 23/02
See application file for complete search history.

(56) References Cited

U.S. PATENT DOCUMENTS

| | | | | |
|---|---|---|---|---|
| 2013/0127350 | A1* | 5/2013 | Frias, Sr. | H05B 45/44 315/185 R |
| 2015/0260384 | A1* | 9/2015 | Purdy | H05B 45/10 362/221 |
| 2017/0027028 | A1* | 1/2017 | Segers | H05B 45/3578 |

OTHER PUBLICATIONS

Georg Kloters und Steffen Henning: "LED-Signalgeber-zehm Jahre Erfahrun im Eisenbahnbetrieb," vol. 105, No. 4, dated Apr. 1, 2013, pp. 18-27.

* cited by examiner

LUMINOUS DEVICE FOR RAIL WAYS SIGNALS AND THE LIKE, AND MANAGEMENT METHOD THEREOF

This Application is a United States National Stage Application under 35 U.S.C. Section 371 of International Patent Application No. PCT/IB2018/055318 filed on 18 Jul. 2018, which is hereby incorporated by reference as if fully set forth herein. This Application also claims priority to and the benefit of European Patent Application No. 17191872.5, filed on 19 Sep. 2017, which is also hereby incorporated by reference as if fully set forth herein.

The present invention relates, in a general aspect thereof, to luminous lighting devices and luminous signalling devices.

Before proceeding further, it is appropriate to point out that in the following description and in the appended claims, reference will mostly be made to luminous devices and/or signals used in the railway, tramway and/or rail and tram fields, i.e. devices employed for adjusting and controlling circulating convoys such as trains, underground trains, tram cars, and the like.

This should not however be understood to be a limiting factor, since the description provided herein can also be extended to other applications, such as, for example, luminous devices or signals for road control or for public lighting networks, namely applications wherein the proper operation of said devices or signals is verified by checking the current being absorbed by them.

As is known, in recent years the lighting systems of railway signals have undergone a technological evolution that has resulted in the utilization of light emitting diodes (LEDs) as substitutes for filament lamps, after temporarily switching to halogen lamps; both of these lamp types can be referred to also as bulb lamps.

When compared to filament or halogen lamps, LED lights last longer and show a lower failure rate; in addition, LED lights ensure a lower current absorption than bulb lamps, the produced light being equal.

The LED lighting technology has thus become increasingly widespread in the last few years, or anyway in relatively recent times, while most railway, road or public lighting networks were built or installed in the past and may be as old as several decades.

It is therefore not conceivable, essentially for economical reasons, to replace entire existing signalling networks designed for bulb lamps with new networks specifically designed for LED lighting and/or signalling devices.

What can be done is to replace the individual bulb lamps with LED lamps in the existing networks. However, this implies some consequences as concerns the management and control of the signalling networks.

In the railway field, the LED lamps used in the luminous signals must be interchangeable with the bulb lamps currently installed.

For this reason, a luminous signal comprising a LED lamp must be able to absorb the same power as a halogen or filament lamp (approx. 25 Watt in normal operating conditions), because the proper operation of the lamps employed in railway signals is verified by checking the absorbed electric power.

Therefore, in order to make it possible to use LED lamps in existing signalling networks, a dummy load R (see FIG. 1) is arranged in parallel to the LEDs L of said lamp, so that an absorption value close to 25 W can be reached.

In this manner, filament or halogen lamps can be replaced with LED lamps in route-based central electric traffic control apparatuses (also referred to as ACEI systems); in such systems, in fact, lamp operation is verified by means of differential amperometric detectors, which energize/de-energize a relay A on the basis of the electric current being absorbed by the lamp.

The current absorbed by the lamp located within a luminous signal allows determining whether said lamp is in a normal condition or in a malfunctioning condition (open circuit or short circuit).

A pair of predefined current thresholds define a control range (also referred to as "amperometric window") and determine the energized/de-energized state of the relays A; in particular, power is normally supplied to such relays (by energizing the coils thereof) when a luminous signal is in normal operating conditions (lamp on), while the relays are turned off (by de-energizing the coils thereof) when the signal is malfunctioning (e.g. the lamp filament is broken).

As described above with reference to ACEI systems, in the latest generation of centralized computer equipment (also known as "ACC systems") the luminous devices are monitored by using analog circuits that detect/measure the absorbed current, and analog-to-digital converters (ADC) that sample the signal outputted by said analog circuits and convert it into a bit string, which can then be sent to an interface of a 2oo2 system; the proper operation of the signal is then evaluated by measuring the absorption current of the same and by comparing this value to the predefined current range. The current range has the same minimum and maximum thresholds as the differential detector of the ACEI system.

Because a static (and continuous) detection of the absorbed current is made in order to check if the intensity value of said current is between a minimum value and a maximum value of the control range, when LED lamps are used it is necessary to include a dummy load.

In fact, this dummy load allows the luminous signal to absorb current having a sufficiently high intensity, so as to prevent the relay A from being de-energized, resulting in a false alarm.

With the present amperometric monitoring methods, the signal's proper operating condition is checked statically on the basis of the measured absorption current.

For this purpose, in order to ensure an absorption value of 25 W in normal conditions, LED signals need to be associated with a dissipative electric load (or dummy load). The high luminous efficiency that is typical of LED devices leads to obtain a power dissipated by the optical/luminous part alone which is equal to approx. two fifths (i.e. 10 Watt) of the total power absorbed by the signal, while the remaining three fifths (i.e. 15 Watt) are dissipated by the dummy load.

Therefore, simply replacing bulb lamps, i.e. filament or halogen lamps, with LED lamps will not lead to an (immediate) reduction of the power consumption of the luminous signalling infrastructure.

The present invention aims at solving these and other problems by providing a LED luminous device particularly, but not exclusively, intended for use in at least one railway signal, which device has the features set out in the appended claim 1.

Furthermore, the present invention aims at solving these and others problems by providing also a method for managing said luminous device.

The basic idea of the present invention is to use current interruption means in a luminous signalling and/or lighting device, wherein said interruption means are configured for periodically interrupting the current flowing through a dummy load (thus enabling or disabling the electric activation thereof) when the LED lighting means are in a condition of proper operation (i.e. when they are emitting light), so as to reduce the intensity of the current absorbed by said luminous device compared to a luminous device according to the prior art. In conditions of luminous degradation of the signal, the absence of said periodic interruption of the dummy load is detected by the system, which then determines the malfunctioning state.

This is useful for reducing the electric energy consumption by at least one luminous railway signal, without jeopardizing the effectiveness of the existing amperometric monitoring systems.

By doing so, it is possible to benefit from the lower consumption of LED lamps while still maintaining a SILO safety integrity level and still complying with the CENELEC European regulations (EN 50129 and EN 50126).

Further advantageous features of the present invention are set out in the appended claims.

These features as well as further advantages of the present invention will become more apparent from the following description of an embodiment thereof as shown in the annexed drawings, which are supplied by way of non-limiting example, wherein:

FIG. 5 shows a graph representing the trend of the intensity of a current absorbed by the luminous device of FIG. 2 when said device is constantly activated, i.e. when it is fixedly on;

Figure 1:
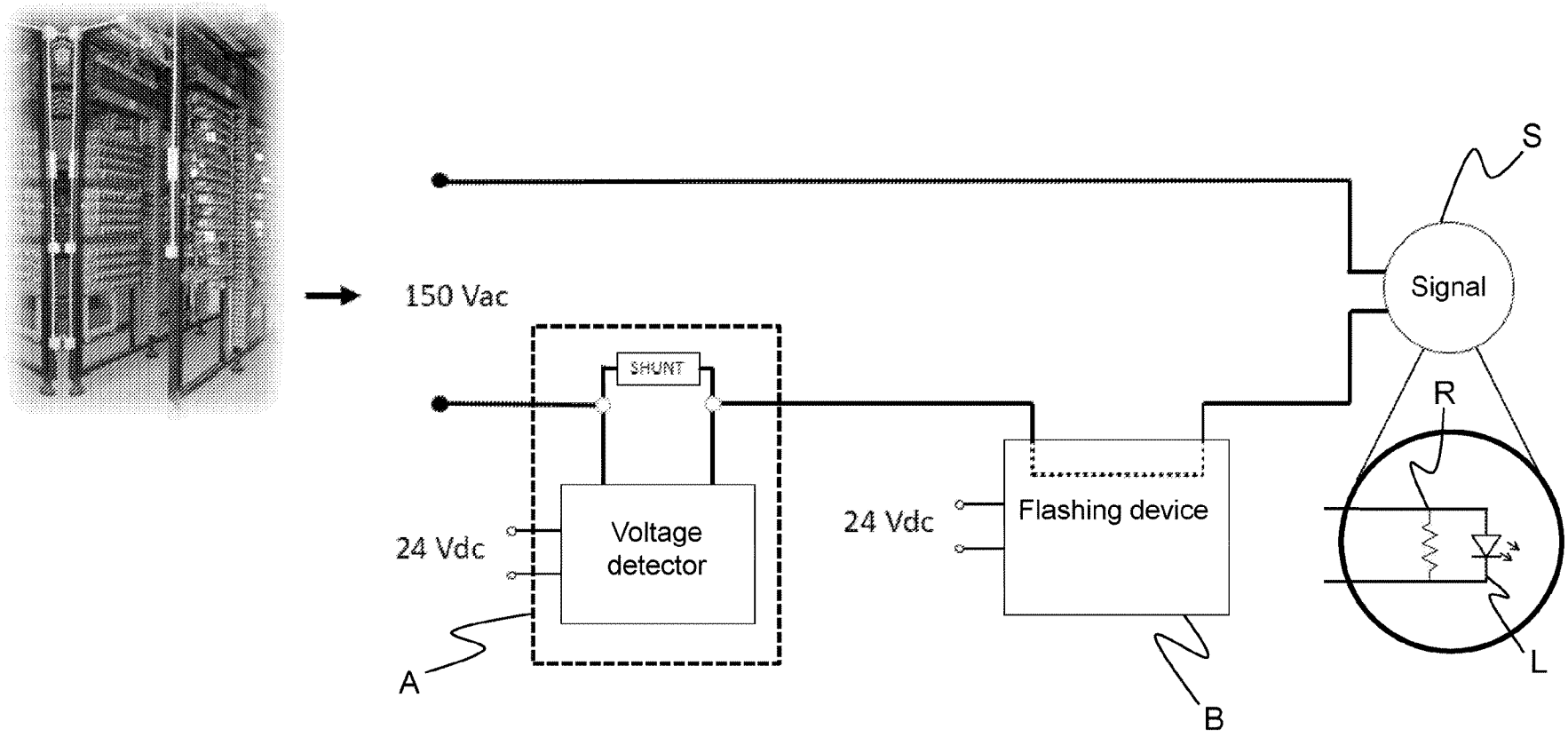
Prior Art Fig. 1
FIG. 1 illustrates a luminous signalling system for railway networks according to the prior art, in accordance with the signal monitoring principles of ACEI systems.
Figure 2:
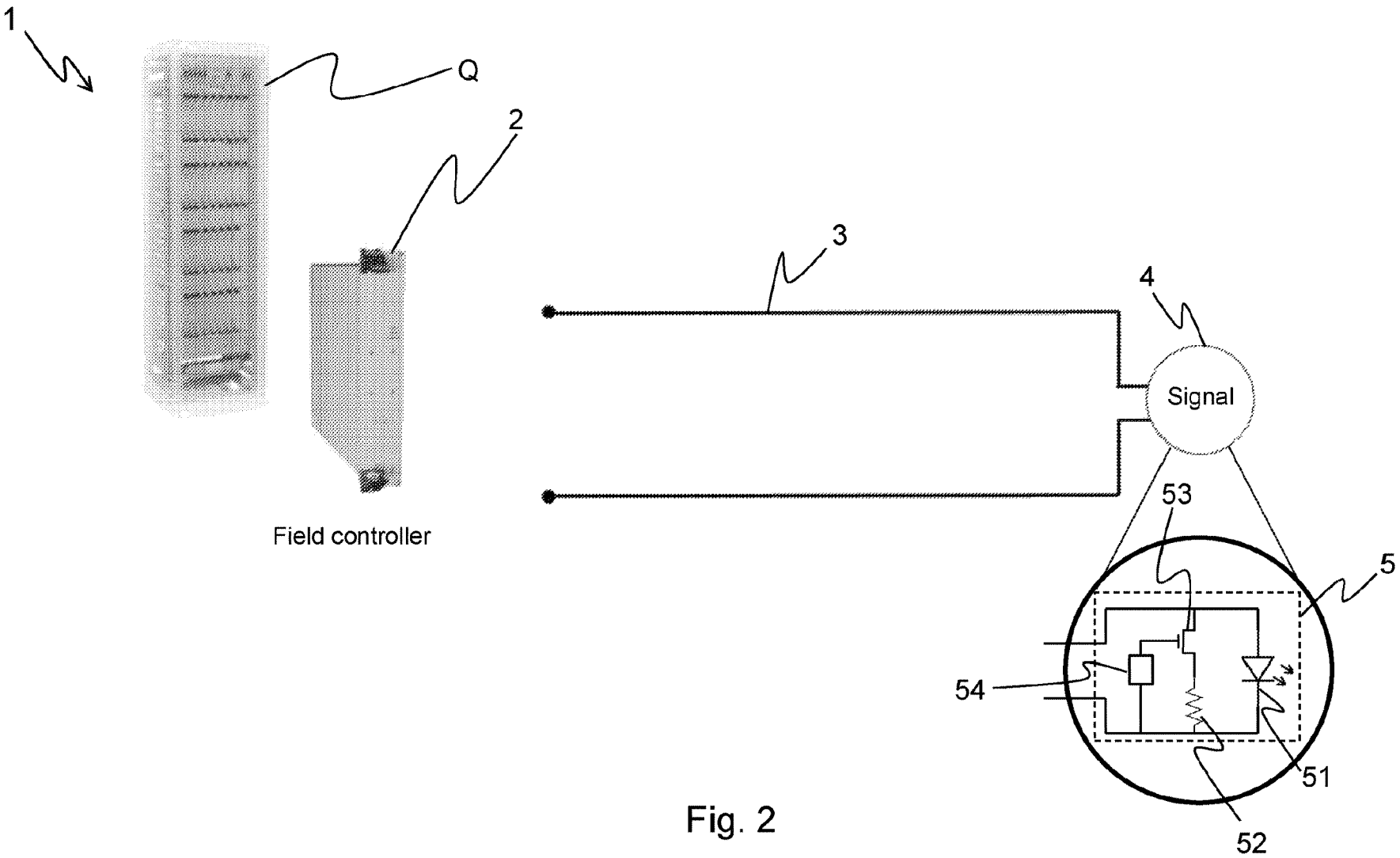
FIG. 2 illustrates a luminous signalling system for railway networks comprising a luminous device according to the invention, managed by the ACC system.
Figure 6:
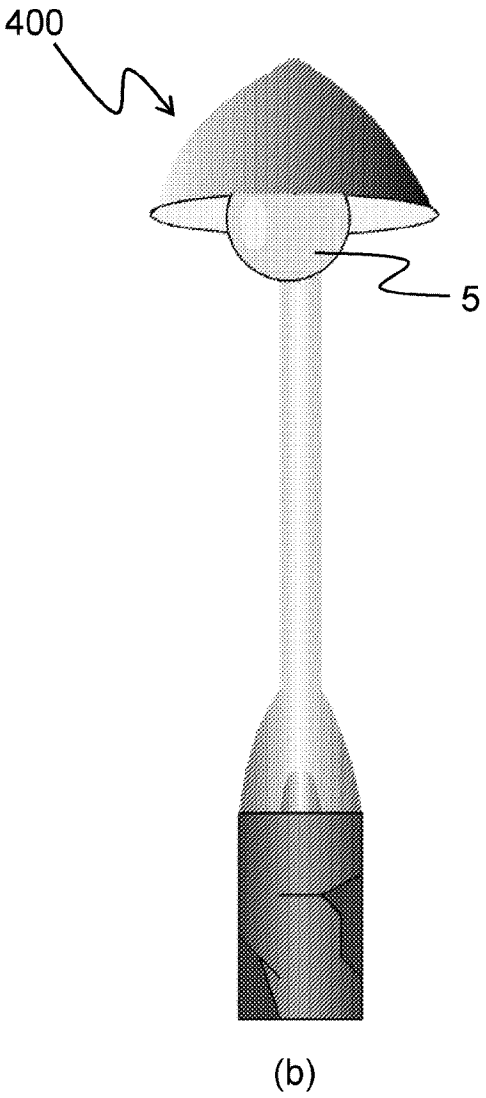
Figure 6:
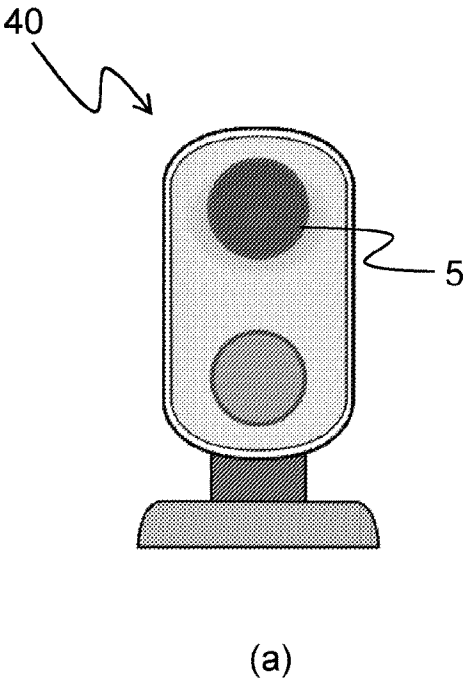

FIGS. 6(*a*)-(*b*) illustrate, respectively, a traffic light and a street lamp, both of which comprise the luminous device of FIG. 2.

Any reference to "an embodiment" in this description will indicate that a particular configuration, structure or feature is comprised in at least one embodiment of the invention. Therefore, the phrase "in an embodiment" and other similar phrases, which may be present in different parts of this description, will not necessarily be all related to the same embodiment. Furthermore, any particular configuration, structure or feature may be combined in one or more embodiments as deemed appropriate. The references below are therefore used only for simplicity's sake and do not limit the protection scope or extent of the various embodiments.

With reference to FIG. 2, the following will describe a luminous signalling system 1 for railway networks; said system comprises a field controller 2, a power line 3, and a luminous signal 4 powered by means of said power line 3 and comprising a luminous device 5 according to the invention.

The field controller 2 (installed in ACC 1 peripheral station cabinets) is configured for carrying out the following activities:

activating said signal 4 by allowing a supply current to flow along the power line 3, e.g. by energizing a mechanical relay or another type of remote-control switch or by enabling electric conversion devices;

detecting and/or measuring, during a sampling time interval, an (effective) value of the intensity of said supply current flowing along said power line 3, e.g. by using a shunt resistor crossed by said supply current and an analog-to-digital converter that samples the voltage drop across said shunt resistor;

determining an operating state of said luminous device 5 on the basis of said supply current intensity value, e.g. by verifying that said value is within a range defined by a minimum value (0.15 Ampere) and a maximum value (0.17 Ampere).

The luminous device 5 comprises the following parts:

LED lighting means 51 (e.g. an array of LEDs connected in series and/or in parallel, together with load resistors having appropriate values connected in series to said LEDs) for illuminating said at least one railway signal 4;

means for monitoring the operation of the LED lighting part, e.g. circuits for reading the current and voltage supplied thereto, for the purpose of determining the operating or malfunctioning state of the lighting means 51;

a dummy load 52 (also referred to as "ballast load"), e.g. a passive resistive load or even an active load, adapted to increase the current intensity (also referred to as "supply current") absorbed by the device 5 when the LED lighting means 51 are in an operating condition, i.e. adapted to increase an electric power dissipated by the device 5 when the LED lighting means 51 are emitting light;

current interrupting means 53, e.g. a MOSFET or another type of fast-switching component, configured for periodically interrupting/restoring the flow of current through said dummy load 52 when the LED lighting means 51 are operating correctly, or for continuously interrupting the flow of said current when the LED lighting means 51 are malfunctioning, so as to reduce the electric power dissipated by said device 5.

This reduces the average intensity of the supply current, resulting in a lower power consumption of the signal 4 when it is working properly.

More in detail, the current interrupting means 53 are preferably connected in series to said dummy load 52, and both (i.e. the dummy load 52 and the current interrupting means 53) are preferably connected in parallel to the LED lighting means 51.

When the luminous device 5 is in an operating condition, said device executes the method of management according to the invention; said method comprises the following phases:

a phase of proper operation of the LED lighting means 51, wherein, via the current interrupting means 53, the flow of current through said dummy load 52 is periodically interrupted/restored;

a phase of malfunction or degradation of the LED lighting means 51, wherein, via the current interrupting means 53, the flow of current through said dummy load 52 is stably and permanently interrupted.

In this way, the presence of such a modulation of the dummy load 52 (obtained periodically by interrupting/restoring the flow of current through the dummy load 52), which is reflected as a modulation of the current absorbed by the luminous device 5, leads the field controller 2 to detect the proper operating condition of the signal; the absence of such a modulation is detected by the system, which will then determine the malfunctioning condition of the device.

This reduces the average intensity of the supply current, resulting in a lower power consumption of the signal 4 when it is in the operating condition.

In combination with the above, the luminous device 5 may also comprise control electronics (e.g. a microcontroller or other types of programmable-logic devices) configured for:

activating and deactivating the current interrupting means 53 at regular time intervals (i.e. cyclically), so as to control the circulation of electric current through the dummy load 52, and hence the electric power dissipated by said resistive load 52;

measuring the electric parameters delivered to or detected in the lighting means 51 in order to determine the malfunctioning/properly operating condition of the same.

As aforementioned, the field controller 2 detects and/or measures the current supplied to said signal 4 within a sampling time interval, preferably in a cyclical manner and with a certain sampling frequency. The driving means 54 are preferably configured for activating the current interrupting means 53 before the beginning of the sampling time interval, so as to allow the circulation of current through the dummy load 52, and for deactivating said current interrupting means at the end of the sampling time interval, so as to interrupt the circulation of current through said dummy load 52. The periodicity of the current interruption interval of the dummy load 52 must be such that it can be detected as a variation in the current absorbed by the device 5 by the field controller 2, so that the latter can determine the operating state of the luminous device 5.

Figure 3:
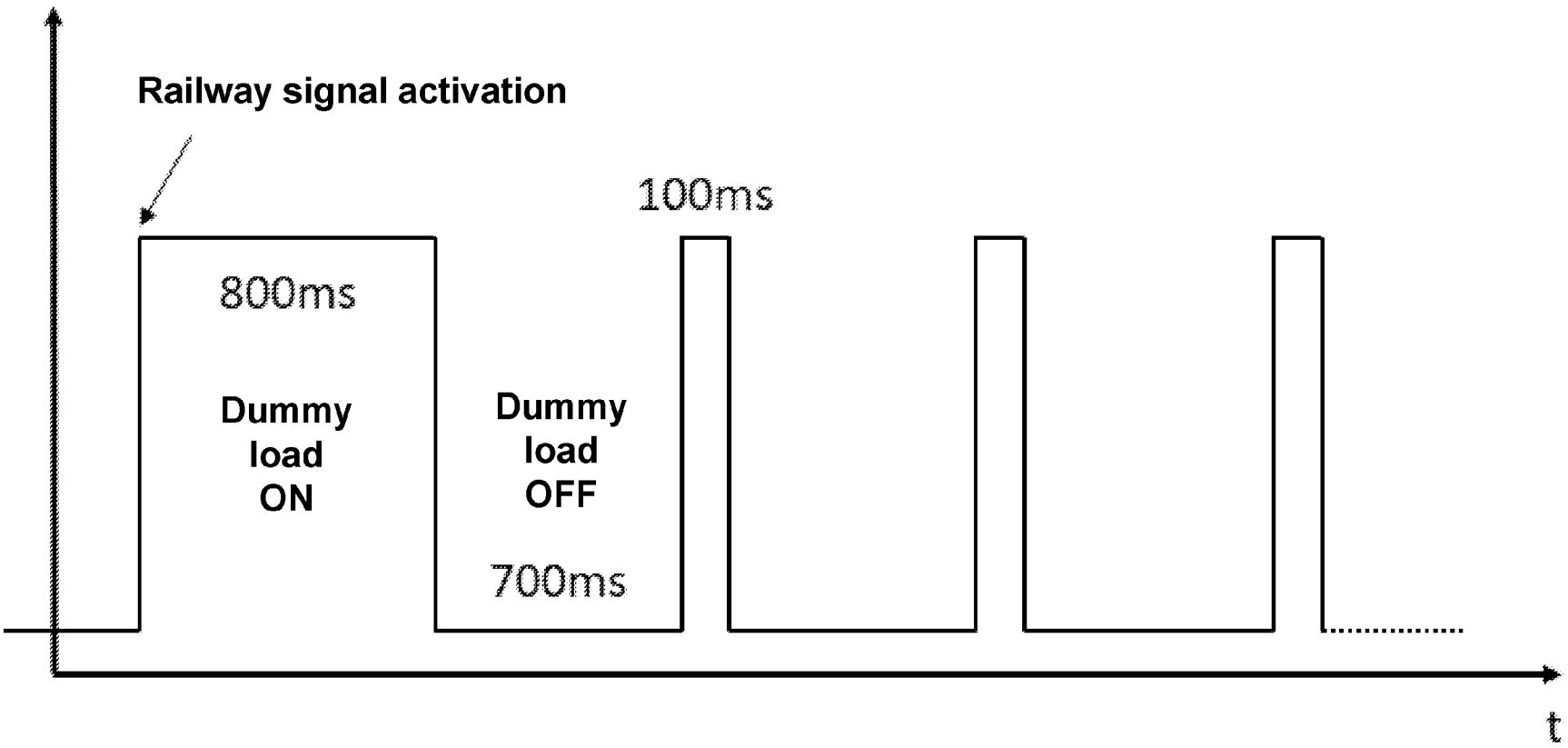
FIG. 3 shows a graph representing the trend of the signal for activating/deactivating the dummy load of the luminous device of FIG. 2 when the latter is operating properly.

Also with reference to FIG. 3, the following will describe a typical way of managing the activation and deactivation of the dummy load 52; in particular, the following will describe the time trend in relation to the ON-OFF period of activation of the dummy load, for the purpose of ensuring a good compromise between the fast response of the system 1 in detecting a malfunction and the reduction in the power dissipated by the dummy load 52 alone (approx. 90%).

More in detail, when the luminous device 5 is turned on, the dummy load 52 is kept active by the current interrupting means 53 for a time interval lasting 800 ms. In other words, the driving means 54 are configured for allowing, via the current interrupting means 53, electric current to flow through the resistive load 52 for a time interval lasting 800 milliseconds starting from when the LED lighting means 51 begin emitting light (i.e. when they are activated by the field controller 2).

Figure 4:
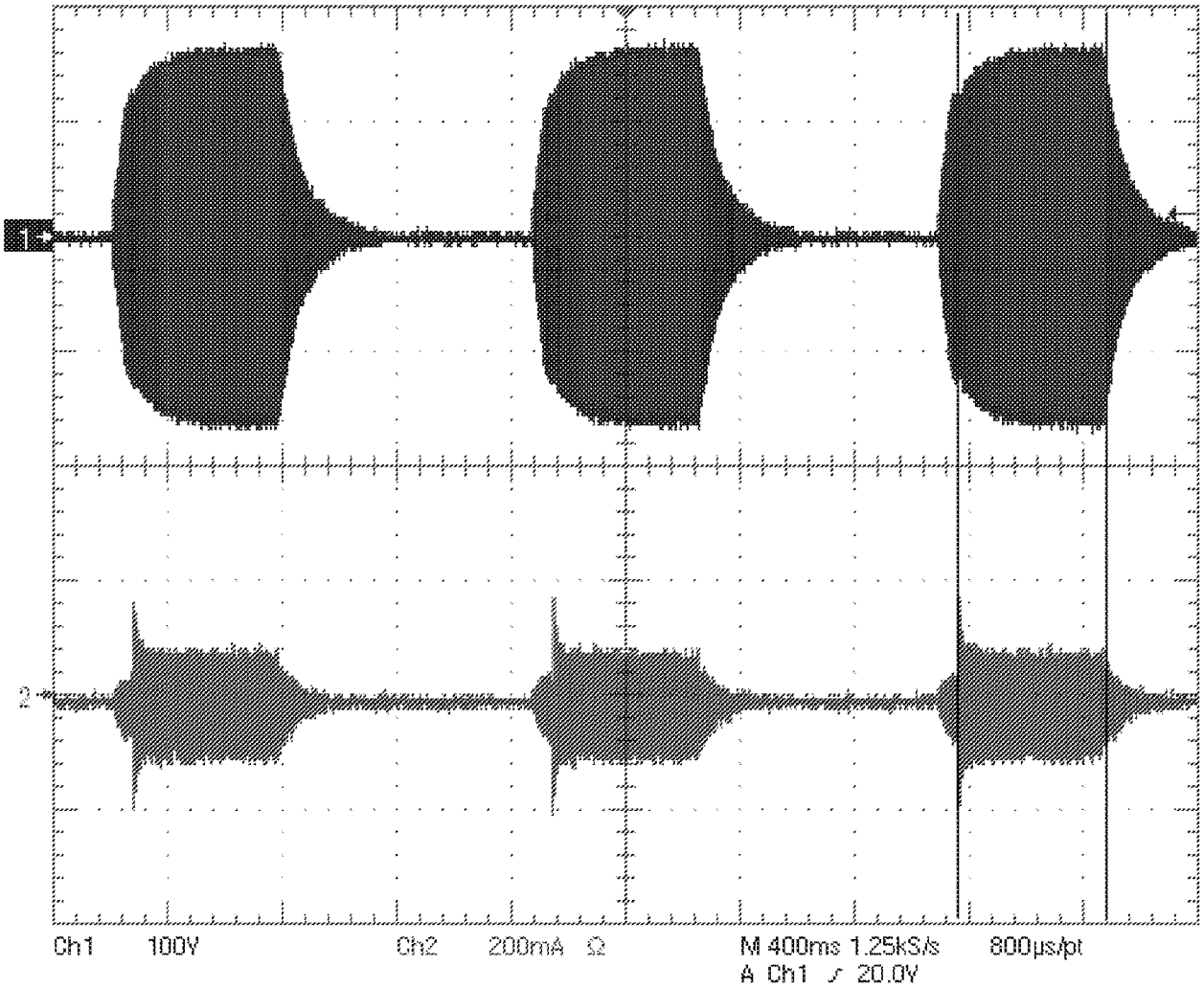
FIG. 4 shows a graph representing the trend of the voltage and intensity of a current absorbed by the luminous device of FIG. 2 when said device is activated and deactivated at regular intervals, i.e. during the flashing phase.

Said time of 800 ms has been evaluated considering the ON time (LED signal on) of the luminous device 5 when it is flashing; as regards this operating condition, FIG. 4 shows an oscilloscope image of the input current (Ch2) and supply voltage (Ch1) of the signal. According to this graph, the time interval in which the LED signal is on is approx. 520 ms; therefore, in the signal's flashing condition the time is less than 800 ms (duration chosen for the initial activation of the ballast load), in compliance with the system requirements of railway networks.

After the initial time condition of 800 ms in which the dummy load is active (which is necessary for verifying the amperometric monitoring conditions of the signal when the latter is controlled as a flashing unit), the latter is driven with a period of 800 ms and a duty cycle of 12.5% (dummy load enabled for 100 ms, dummy load disabled for 700 ms) throughout the time in which the signal 4 is kept active.

Figure 5:
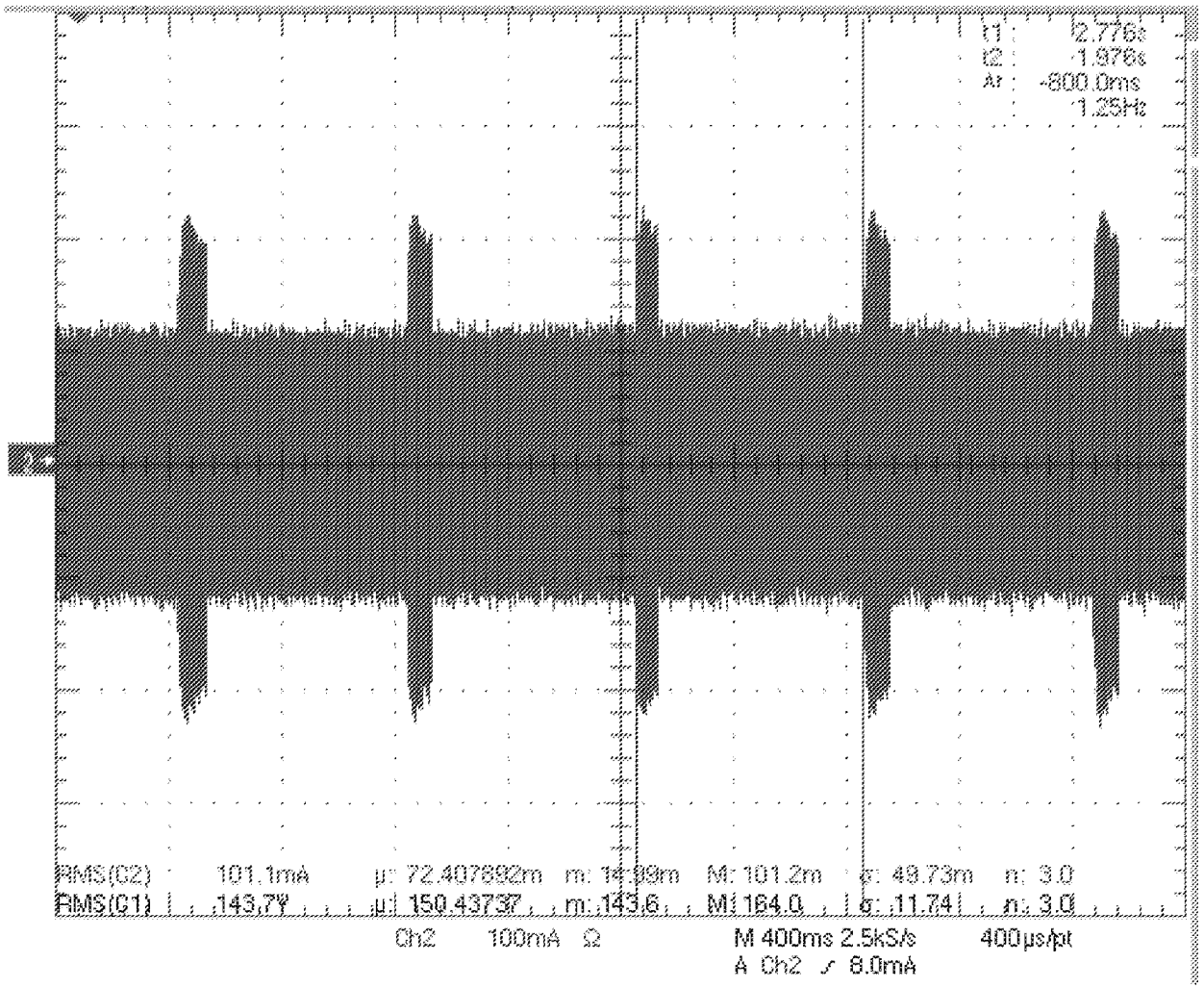

When the field controller 2 activates the signal 4 in continuous mode (fixed light, i.e. non-flashing, condition), the driving means 54 can allow or interrupt, via the current interrupting means 53, the flow of current through the dummy load 52 in a cyclical manner (ON-OFF modulation of the dummy load) with the times defined in FIG. 3. In particular, FIG. 5 shows the trend of the current absorbed by the signal when it is controlled as a fixed light in a condition of proper operation of the lighting means 51; the periodicity of the current variations shown in FIG. 5 corresponds to the period of activation/deactivation of the dummy load of the signal 4. This reduces the average intensity of the supply current, resulting in a lower power consumption of the signal 4 within a given time interval. This also reduces the heat dissipation caused by the Joule effect generated inside the signal 4, resulting in higher reliability of the latter.

In such a situation, the field controller 2 detects the condition of proper operation of the signal 4, by verifying the periodicity of activation/deactivation of the ballast load via a measurement of the current absorbed by the signal and, in particular, of the current absorption increase generated by the periodic interruption of the ballast load; the field controller 2 will detect the malfunctioning, or error, condition due to degradation of the signal 4 if, after the 700 ms time (corresponding to the OFF period of the ballast load and to the minimum value of the current absorbed by the signal), no detection occurs of a value of the current absorbed by the signal (due to the ON condition of the ballast, corresponding to the maximum value of the current absorbed by the signal) that generates an increment delta in the absorption defined by the enabled/disabled condition of the ballast.

This solution allows reducing the power dissipated by the dummy load of the signal by approx. 90%, and allows the field controller to detect a faulty or malfunctioning condition within 700 ms.

Of course, the example described so far may be subject to many variations.

A first variant comprises, in addition to the above-described technical features, also a switch (preferably a DIP switch) that keeps the current interrupting means 53 always active, i.e. constantly supplying power to the dummy load 52. The luminous device 5 can thus be used also in ACEI systems, wherein the supply current is detected/measured continuously (statically). Therefore, the dummy load 52 can be activated statically, if the LED signal must replace a lamp in an ACEI system; when the system is upgraded from ACEI to ACC, the functionality of activation/deactivation of the dummy load 52 can be activated via the switch, thus ensuring all the advantages set out in this description.

The present description has tackled some of the possible variants, but it will be apparent to the man skilled in the art that other embodiments may also be implemented, wherein some elements may be replaced with other technically equivalent elements.

With reference to the initial introduction, it can also be stated that other variants of the invention may derive from applications for luminous devices and control networks characterized by problems similar to those of railway signalling.

For example, one may consider road traffic signalling networks (traffic lights, flasher lamps) and/or public lighting networks (street lamps, beacons, projectors, etc.).

In such cases as well, there are networks of luminous devices that utilize bulb lamps that need, or should, be replaced with LED lamps.

The operation and the state of such luminous devices can be monitored in accordance with the invention.

Also with reference to FIGS. 6(*a*) and 6(*b*), and as aforementioned, the device 5 according to the invention can be included in a traffic light 40 and/or a street lamp 400. It will thus be possible to use the amperometric monitoring systems already present in existing networks.

The present invention is not therefore limited to the explanatory examples described herein, but may be subject to many modifications, improvements or replacements of equivalent parts and elements without departing from the basic inventive idea, as set out in the following claims.

The invention claimed is:

1. A luminous device, comprising

LED lighting means, a dissipative dummy load for increasing the electric power absorbed by the device when the LED lighting means are emitting light, and current interrupting means configured for interrupting the flow of current in said resistive load when the LED lighting means are emitting light, so as to reduce the electric power dissipated by said device.

2. The luminous device according to claim 1, wherein the current interrupting means are connected in series to said resistive load, and wherein the dummy load and the current interrupting means are connected in parallel to the LED lighting means.

3. The luminous device according to claim 1, comprising driving means configured for cyclically activating and deactivating the current interrupting means, and for detecting and measuring electric quantities of the lighting means, so as to control the electric power dissipated by said resistive load.

4. The luminous device according to claim 3, wherein the driving means are configured for allowing, via the current interrupting means, a flow of electric current through the resistive load for a time interval lasting 800 milliseconds starting from when the LED lighting means begin emitting light.

5. The luminous device according to claim 4, wherein the driving means are configured for allowing and interrupting, via the current interrupting means, the flow of current through the dummy load with a period of 800 milliseconds and a duty cycle of 12.5%.

6. The luminous device according to claim 1, associated with, or incorporated into, a signal for railway signaling.

7. The luminous device according to claim 1, associated with, or incorporated into, a signal for road signaling.

8. The luminous device according to claim 1, associated with, or incorporated into, a public lighting support for roads, buildings and environments in general, such as a street lamp, a lamp, a beacon, a projector, or the like.

9. A luminous signaling system for railway networks, road networks, or the like, comprising a luminous device according to claim 1, a power line supplying power to said luminous device, and a field controller configured for activating said signal by allowing a supply current to flow along the power line, detecting and/or measuring, during a sampling time interval, a value of the electric power transferred by said supply current flowing along said power line, determining an operating state of said luminous device on the basis of said value of transferred electric power, and wherein the driving means are configured for activating the current interrupting means, so as to allow the circulation of current through said dummy load, before the beginning of said sampling time interval, and deactivating said current interrupting means, so as to stop the circulation of current through said dummy load, at the end of said sampling time interval.

10. A railway, road or similar signal, comprising a luminous device according to claim 1.

11. A method for managing a luminous device according to claim 1, wherein a resistive load is adapted to increase an electric power dissipated by the luminous device when LED lighting means are emitting light, comprising a dissipation phase, wherein current is allowed, via current interrupting means, to flow through said ballast load when the LED lighting means are emitting light, and an interruption phase, wherein the flow of current through said ballast load is interrupted, via current interrupting means, when the LED lighting means are emitting light.

12. A use of a luminous device according to claim 1, within a railway or tramway signaling network, or the like.

* * * * *